US007170460B2

(12) United States Patent
Miyahara

(10) Patent No.: US 7,170,460 B2
(45) Date of Patent: Jan. 30, 2007

(54) POLARIZED WAVE SEPARATOR, CONVERTER FOR SATELLITE BROADCAST RECEPTION, AND ANTENNA DEVICE FOR SATELLITE BROADCAST RECEPTION

(75) Inventor: Jiro Miyahara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 18 days.

(21) Appl. No.: 11/047,727

(22) Filed: Feb. 2, 2005

(65) Prior Publication Data

US 2005/0190113 A1 Sep. 1, 2005

(30) Foreign Application Priority Data

Feb. 27, 2004 (JP) ..... 2004-052908

(51) Int. Cl.
*H01Q 19/00* (2006.01)

(52) U.S. Cl. ..... 343/756; 343/909

(58) Field of Classification Search ..... 343/756, 343/786, 909; 333/21 A
See application file for complete search history.

(56) References Cited

U.S. PATENT DOCUMENTS 5,041,840 A * 8/1991 Cipolla et al. ..... 343/725
6,445,260 B1 * 9/2002 Miyazaki et al. ..... 333/21 A
6,452,559 B1 * 9/2002 Yuanzhu ..... 343/756
6,507,323 B1 * 1/2003 West ..... 343/772
6,522,215 B2 * 2/2003 Enokuma ..... 333/21 A
6,661,390 B2 * 12/2003 Gau et al. ..... 343/786
6,839,037 B1 * 1/2005 Stokes et al. ..... 343/786
2003/0179147 A1 * 9/2003 King et al. ..... 343/786

FOREIGN PATENT DOCUMENTS

JP 04-271601 9/1992

* cited by examiner

*Primary Examiner*—Hoang V. Nguyen
(74) *Attorney, Agent, or Firm*—Nixon & Vanderhye P.C.

(57) ABSTRACT

A polarized wave separator includes a tubular waveguide, and a partition extending in the waveguide along the longitudinal direction thereof. The end of the partition facing the longitudinal direction is a step-graded end taking a stepped configuration when viewed from the side. A dielectric portion is disposed so as to cover at least the portion of the step-graded end when viewed in the longitudinal direction.

7 Claims, 7 Drawing Sheets

POLARIZED WAVE SEPARATOR, CONVERTER FOR SATELLITE BROADCAST RECEPTION, AND ANTENNA DEVICE FOR SATELLITE BROADCAST RECEPTION

This nonprovisional application is based on Japanese Patent Application No. 2004-052908 filed with the Japan Patent Office on Feb. 27, 2004, the entire contents of which are hereby incorporated by reference.

BACKGROUND OF THE INVENTION

1. Field of the Invention

The present invention relates to a polarized wave separator employed in a converter of an antenna for reception of satellite broadcasting and satellite communication directed to circularly polarized wave reception. Additionally, the present invention relates to a converter and an antenna device for satellite broadcast reception.

2. Description of the Background Art

Microwaves used in satellite broadcasting and satellite communication generally include two components. A typical microwave includes the two components of a right-handed polarized wave and a left-handed polarized wave for the circularly polarized wave. Accordingly, a polarized wave separator to separate these two components are provided in converters directed to receiving circularly polarized waves in satellite broadcasting and satellite communication.

One example of a polarized wave separator is disclosed in Japanese Patent Laying-Open No. 04-271601. There is known the type of a polarized wave separator that includes a step-graded partition inside a tubular member. Such a separator is generally formed of a conductor. The tubular member and partition therein are formed integrally by metal such as aluminum in particular.

The conventional polarized wave separator is produced through casting by means of a mold using metal material such as aluminum. Once the configuration is determined and a mold is produced, the condition of the partition, when required to be modified for property improvement and the like, could not be modified arbitrarily since working on the partition in the tubular member was difficult.

SUMMARY OF THE INVENTION

In view of the foregoing, an object of the present invention is to provide a polarized wave separator, a converter for satellite broadcast reception, and an antenna device for satellite broadcast reception that readily allows fine-adjustment of the property even if production by means of a mold has been initiated.

According to an aspect of the present invention, a polarized wave separator includes a tubular waveguide, and a partition extending in the waveguide along a longitudinal direction thereof. The end of the partition in the longitudinal direction is a step-graded end taking a stepped configuration when viewed from the side. A dielectric portion is disposed so as to cover at least a portion of the step-graded end when viewed from the longitudinal direction. By virtue of such a structure, the property can be easily adjusted by modifying the configuration, position, and material of the dielectric portion provided at the step-graded end of the partition. Since the dielectric portion can be formed of a material that can be readily worked subsequently such as resin, a polarized wave separator that allows fine-adjustment of the property subsequently can be provided.

In the invention of the present aspect, the dielectric portion is preferably formed of dielectric resin. By virtue of this structure, the dielectric portion can be formed easily and economically.

In the invention of the present aspect, the dielectric resin is preferably resin selected from the group consisting of silicon type, epoxy type, acryl type, and urethane type. By virtue of such a structure, a dielectric portion suitable for adjustment of the property can be formed easily and economically.

According to another aspect of the present invention, a converter for satellite broadcast reception includes any of the polarized wave separator set forth above. By employing such a structure, a satellite broadcast reception converter that allows fine-adjustment of the property subsequently can be provided since the property can be readily adjusted by modifying the configuration, position, and material of the dielectric portion provided at the step-graded end of the partition.

According to a further aspect of the present invention, an antenna device for satellite broadcast reception includes the satellite broadcast reception converter set forth above. By employing such a structure, a satellite broadcast reception antenna device that allows fine-adjustment of the property subsequently can be provided since the property can be readily adjusted by modifying the configuration, position, and material of the dielectric portion provided at the step-graded end of the partition.

In accordance with the present invention, not only the configuration of the basic member formed of aluminum and the like, but also the configuration, position, and material of the dielectric portion provided at the step-graded end of the partition can be added as the elements determining the property of the partition. Therefore, the property can be readily adjusted by modifying the configuration, position and material of the dielectric portion. Since the dielectric portion can be formed of a material that can be readily worked even afterwards such as resin, as compared to the partition formed of a material that is difficult to be worked such as metal, subsequent fine-adjustment of the property can be conducted readily.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
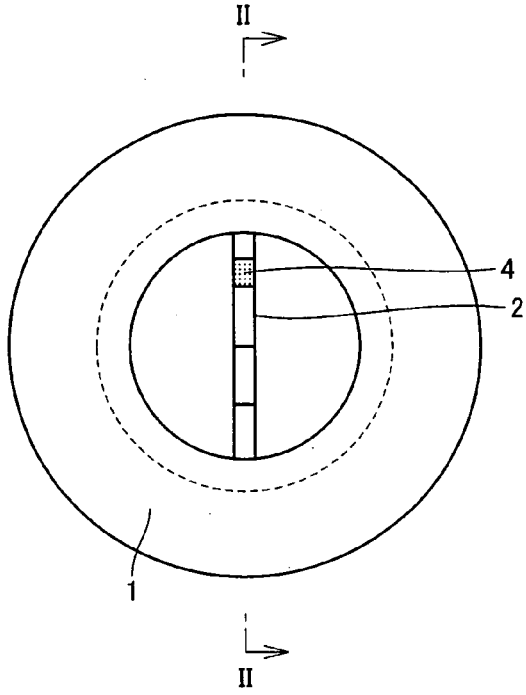
FIG. 1 shows a polarized wave separator according to a first embodiment of the present invention, viewed from one end in the longitudinal direction of the polarized wave separator.

A polarized wave separator 10 according to a first embodiment of the present invention will be described hereinafter with reference to FIGS. 1 and 2. Polarized wave separator 10 includes a tubular waveguide 1, and a partition 2 extending in waveguide 1 along the longitudinal direction of waveguide 1. At least one of the ends in the longitudinal direction of partition 2 is a step-graded end 3 taking a stepped configuration when viewed from the side corresponding to FIG. 2. FIG. 1 corresponds to a view in the direction of arrow 91 of FIG. 2. A dielectric portion 4 is arranged so as to cover at least a portion of step-graded end 3 when viewing step-graded end 3 in the direction of arrow 91, i.e. in the longitudinal direction. Waveguide 1 and partition 2 are formed integrally through casting with aluminum as the material.

Figure 2:
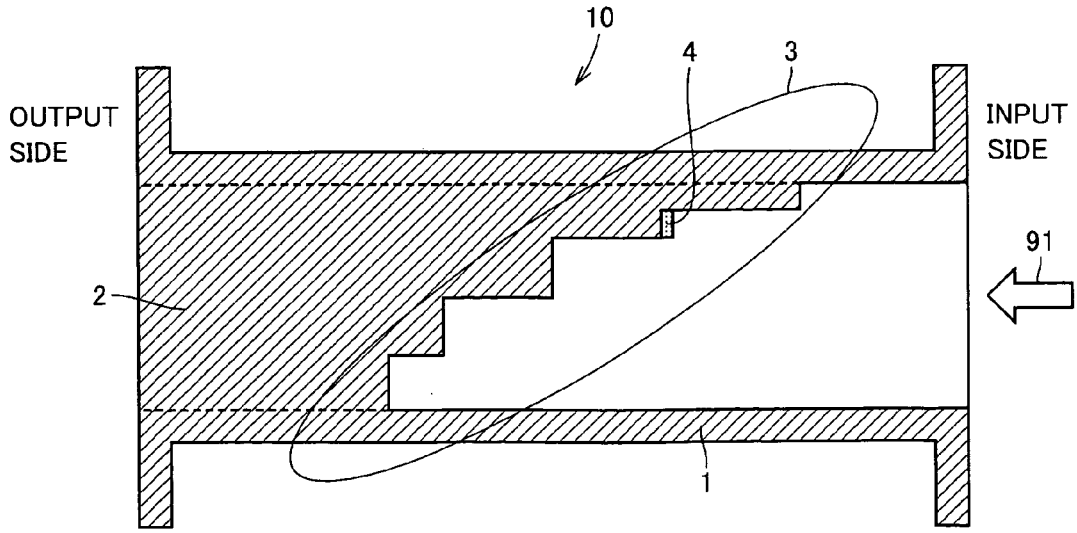
FIG. 2 is a sectional view of the polarized wave separator of FIG. 1 in the direction of the arrow of II—II.

In the present example, dielectric portion 4 is arranged at the second step from the top among the steps of step-graded end 3 in FIG. 2. It will be understood that such description is merely exemplary, and the region where dielectric portion 4 is disposed may be selected appropriately, not limited to the second step. Furthermore, dielectric portion 4 may be arranged in a distributed manner on two or more steps among the steps of step-graded end 3. Alternatively, dielectric portion 4 may be provided across two or more steps among the steps of step-graded end 3.

Figure 3:
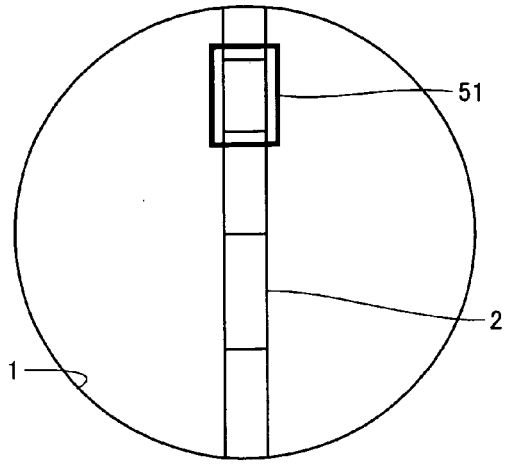
FIG. 3 is a diagram to describe the arrangement of the dielectric portion in the first embodiment of the present invention.
Figure 4A:
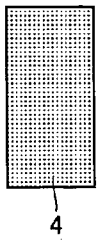
FIGS. 4A–4H represent variations of the dielectric portion of the first embodiment.
Figure 4B:
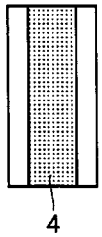
Figure 4C:
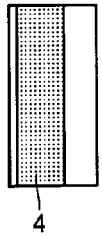
Figure 4D:
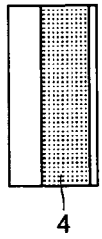
Figure 4E:
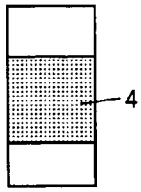
Figure 4F:
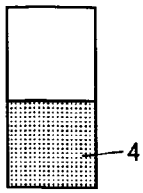
Figure 4G:
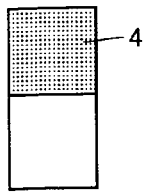
Figure 4H:
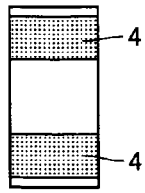

Even in the case where dielectric portion 4 is disposed on one step indicated by a frame 51, for example, in FIG. 3, the arrangement of dielectric portion 4 includes various patterns as shown in FIGS. 4A–4H. FIGS. 4A–4H represent enlargement of the interior of frame 51 of FIG. 3. Dielectric portion 4 may also be arranged so as to cover only a portion of one step. Furthermore, a plurality of dielectric portions 4 may be provided in one step.

The material of dielectric portion 4 is preferably dielectric resin. More preferably, dielectric resin 4 is formed of resin of any of the silicon type, epoxy type, acryl type, and urethane type. This is because such types are readily workable.

The configuration, position, and material of the dielectric portion can be modified appropriately in view of the status of property improvement.

In accordance with the present embodiment, not only the configuration of the basic member formed of aluminum and the like, but also the configuration, position, and material of the dielectric portion provided at the step-graded end of the partition can be added as the elements determining the property of the partition. Therefore, the property can be readily adjusted by modifying the configuration, position and material of the dielectric portion. Since the dielectric portion can be formed of a material that can be readily worked even afterwards such as resin, as compared to the partition formed of a material that is difficult to be worked such as metal, a polarized wave separator that readily allows fine-adjustment of the property subsequently can be provided.

For example, consider the case where it turned out that a polarized wave separator produced by aluminum upon determining the configuration of the aluminum portion based on simulation and experiments could not exhibit the desired property. Provision of the dielectric portion in the polarized wave separator of the present invention allows the property to be improved by fine-adjusting the configuration, position, and material of the dielectric portion. Additionally, in the case where the mold and other fabrication facilities are subjected to variation during the mass production of the polarized wave separators and it is expected that the obtained polarized wave separator may not exhibit the initially desired predetermined property, provision of a dielectric portion in the polarized wave separator allows improvement of the property by fine-adjusting the configuration, position, and material of that dielectric portion.

Although the above embodiment was described in which waveguide 1 and partition 2 are formed of aluminum, these elements may be formed of a conductor material other than aluminum.

Figure 5:
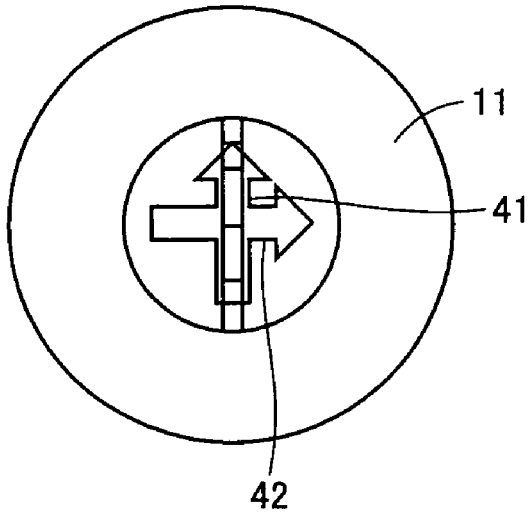
FIG. 5 is a diagram to describe a circular waveguide used at the input side in simulation.
Figure 6:
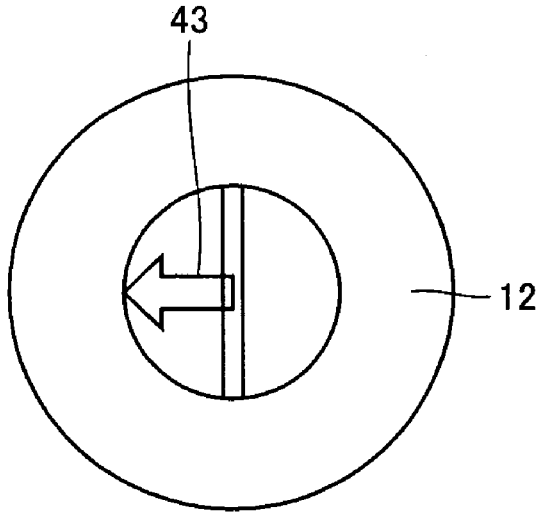
FIG. 6 is a diagram to describe a circular waveguide employed at the output side in simulation.

A simulation was performed to confirm that the property can be improved by virtue of the presence of dielectric portion 4. The simulation was performed under the condition that input is effected by a circular waveguide 11 of FIG. 5 and output by a semi-circular waveguide 12 of FIG. 6 with respect to the polarized wave separator 10 of FIG. 1. The three structural elements of circular waveguide 11, polarized wave separator 10 and semi-circular waveguide 12 are all connected with their direction arranged such that the direction of the partition is identical for all. Dielectric portion 4 formed of silicon resin is disposed at partition 2 of polarized wave separator 10. From circular waveguide 11 is provided a circularly polarized wave including an electric field Eh in a direction parallel to partition 2 corresponding to arrow 41 and an electric field Ev in a direction perpendicular to partition 2 corresponding to arrow 42, as shown in FIG. 5, to polarized wave separator 10. The level of reception identified as the electric field in a direction perpendicular to partition 2 corresponding to arrow 43 of FIG. 6 at semi-circular waveguide 12 as a result of the circularly polarized wave passing through polarized wave separator 10 was evaluated through simulation.

Figure 7:
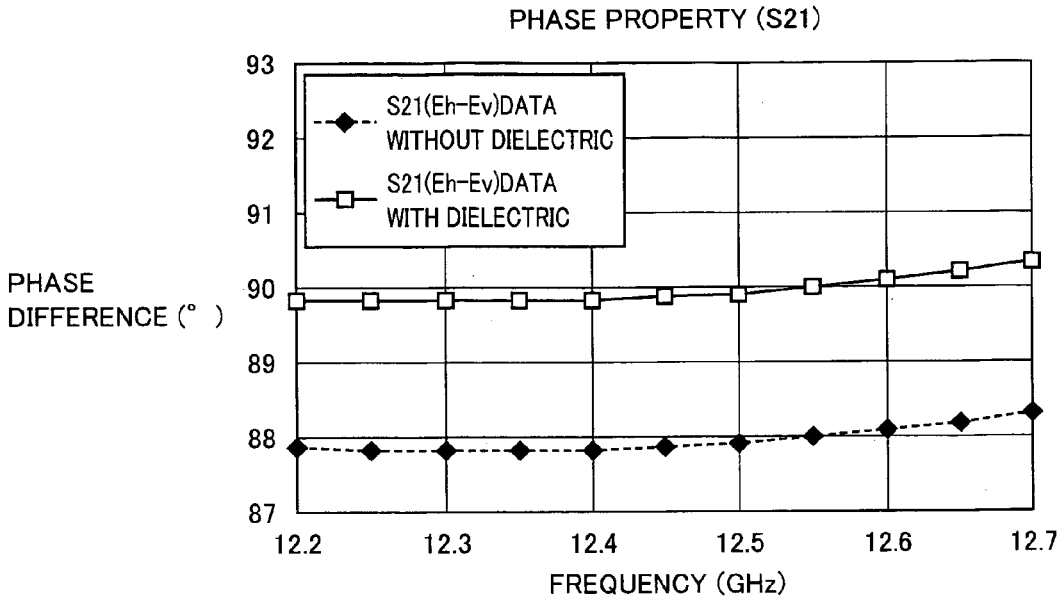
FIG. 7 is a graph representing the phase difference of S21 at respective frequencies obtained by simulation.
Figure 8:
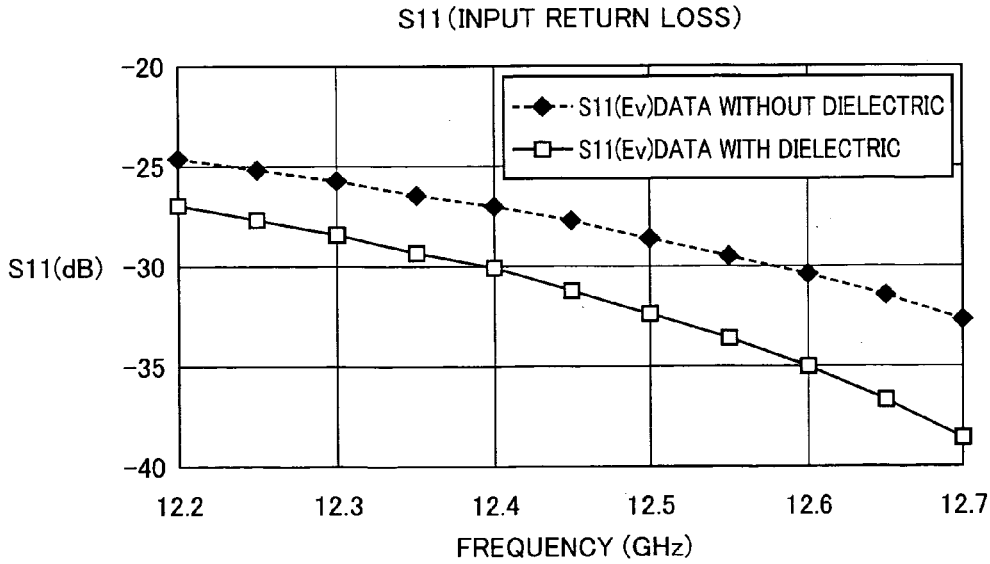
FIG. 8 is a graph representing S11 at respective frequencies obtained by simulation.

The results of simulation are shown in FIGS. 7 and 8. FIG. 7 represents a phase difference of S21 at respective frequencies. It is appreciated from FIG. 7 that the phase difference is as great as approximately 90° when dielectric portion 4 is present, as compared to the case where dielectric portion 4 is absent. FIG. 8 represents the loss of input reflected at respective frequencies, i.e. S11. It is appreciated from FIG. 8 that S11 is lower when dielectric portion 4 is present as compared to the case where dielectric portion 4 is absent, i.e. the loss caused by reflection becomes smaller.

Figure 9:
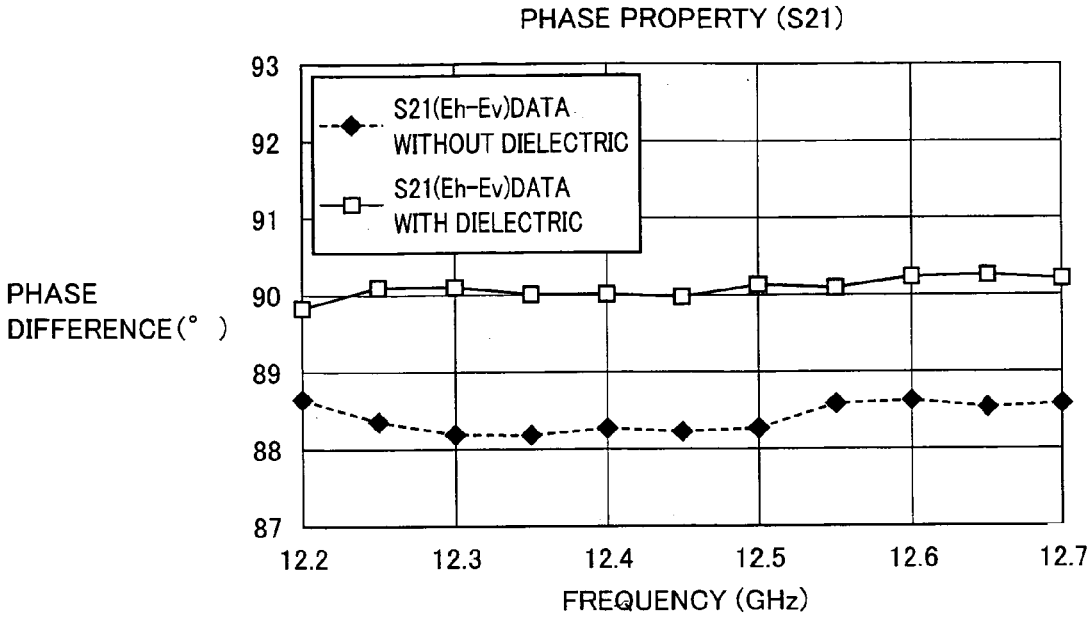
FIG. 9 is a graph representing the actually measured values of the phase difference of S21 at respective frequencies.

The results of experiments actually carried out instead of simulation are shown in FIG. 9 and Table 1. A polarized wave separator similar to that set forth above in the present embodiment was prepared, without dielectric portion 4. By applying silicon resin on partition 2, a dielectric portion 4 of silicon resin was provided. The phase difference was actually measured.

FIG. 9 represents the phase difference property S21 at respective frequencies. It is appreciated that the phase difference is as great as approximately 90° when dielectric portion 4 formed of silicon type resin is present, as compared to the case where there is no dielectric portion 4.

TABLE 1

| | | (Unit: dB) | |
|---|---|---|---|
| | | Left-handed polarized wave is desired Right-handed polarized wave is undesired | Right-handed polarized wave is desired Left-handed polarized wave is undesired |
| No. 1 | Dielectric absent | 28.50 | 23.83 |
| | Dielectric present | 29.33 | 25.00 |
| No. 2 | Dielectric absent | 25.66 | 23.83 |
| | Dielectric present | 27.00 | 27.50 |
| No. 3 | Dielectric absent | 28.00 | 24.50 |
| | Dielectric present | 30.67 | 27.33 |
| No. 4 | Dielectric absent | 25.50 | 26.34 |
| | Dielectric present | 28.66 | 30.83 |
| No. 5 | Dielectric absent | 26.00 | 24.66 |
| | Dielectric present | 27.00 | 25.31 |

Table 1 represents the measured values of cross polarization. On the basis of one of the left-handed polarized wave and right-handed polarized wave being the desired polarized wave and the other being the undesired polarized wave, cross-polarization corresponds to the value of the undesired level subtracted from the desired level. A greater cross polarization is preferable. The experiment was conducted for each of five samples No. 1–No. 5, respectively, including a dielectric portion 4 formed of silicon resin. The worst value of cross polarization in the band of 12.2 GHz–12.7 GHz, i.e. the smallest value among the measurements, is represented in Table 1. It is appreciated from Table 1 that all samples exhibited a larger value of cross polarization when dielectric portion 4 formed of silicon resin is present as compared to the case where there is no dielectric portion 4.

Although only an example based on silicon type resin is disclosed here, a similar effect is achieved for also the epoxy type, acrylic type, and urethane type resin, provided that the dielectric constant of dielectric portion 4 differs.

Second Embodiment

Figure 10:
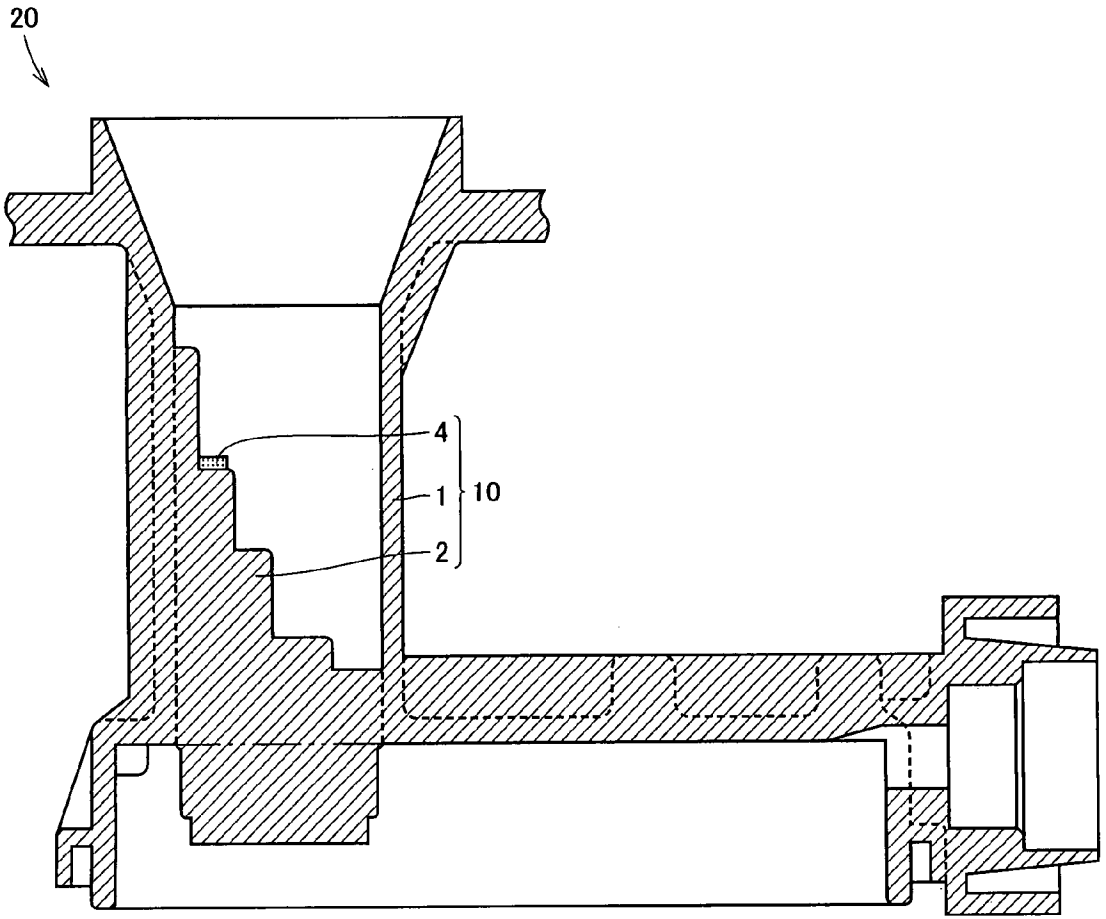
FIG. 10 is a sectional view of a satellite broadcast reception converter according to a second embodiment of the present invention.

Referring to FIG. 10, a converter 20 for satellite broadcast reception according to a second embodiment of the present invention includes polarized wave separator 10 described in the first embodiment.

In the present embodiment, the property can be readily adjusted even after fabrication of the satellite broadcast reception converter by modifying the configuration, position and material of the dielectric portion. Since the dielectric portion can be formed of a material that can be readily worked even afterwards such as resin, as compared to the partition formed of a material that is difficult to be worked such as metal, a satellite broadcast reception converter that readily allows fine-adjustment of the property subsequently can be provided.

In the case where all the portions other than the dielectric portion of the satellite broadcast reception converter are formed integrally through casting using metal, it is extremely advantageous to allow fine adjustment of the property without having to modify the mold by adjusting the dielectric portion since the mold is hefty and costly.

Third Embodiment

Figure 11:
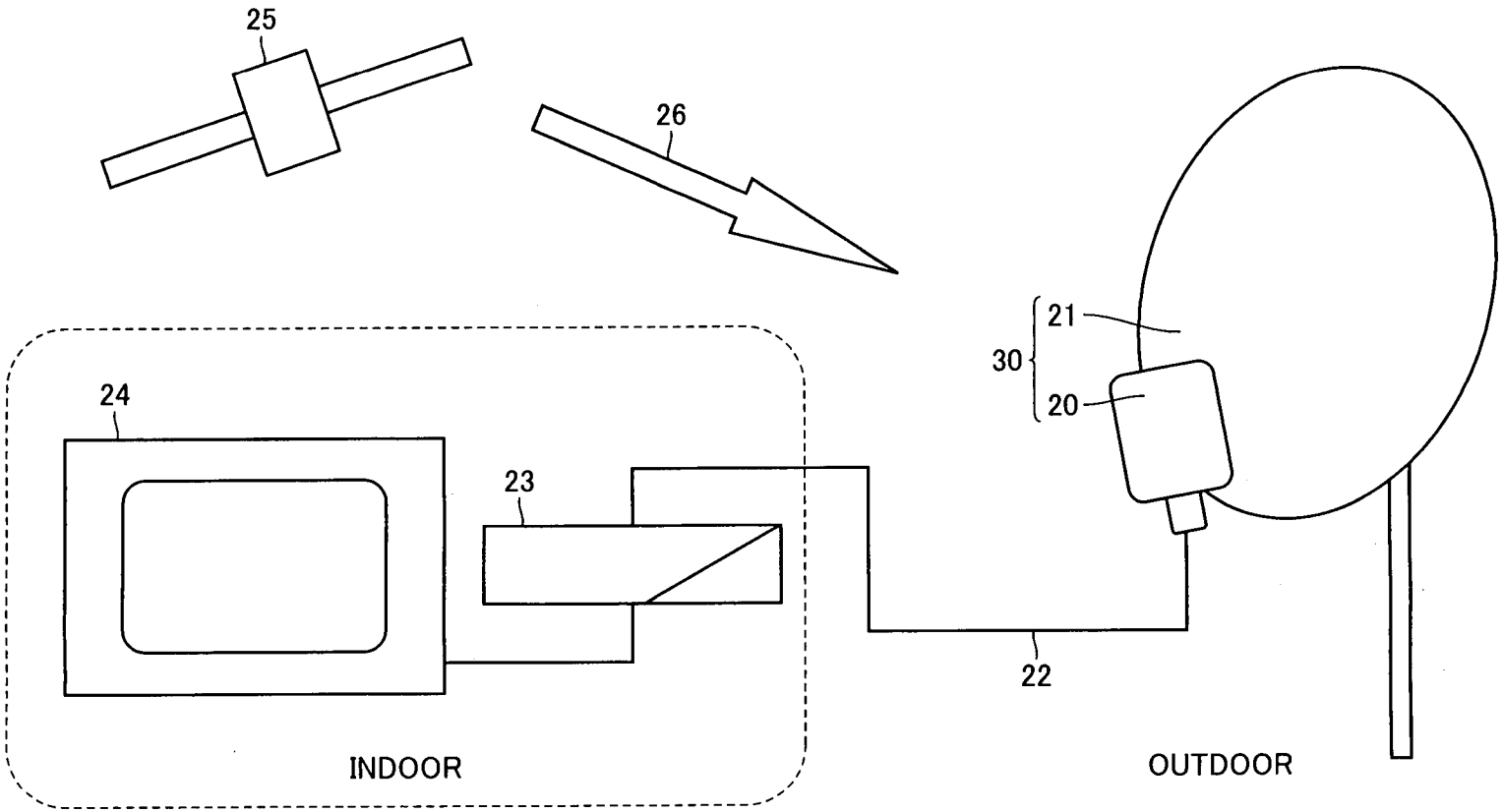
FIG. 11 is a diagram to describe a satellite broadcast reception antenna device according to a third embodiment of the present invention.

Referring to FIG. 11, an antenna device 30 for satellite broadcast reception according to a third embodiment will be described hereinafter. Satellite broadcast reception antenna device 30 includes an antenna unit 21 and satellite broadcast reception converter 20 set forth in the previous second embodiment. Satellite broadcast reception antenna device 30 functions to receive a circularly polarized wave 26 from a broadcasting satellite 25. Circularly polarized wave 26 reflected at antenna unit 21 to be gathered is input to converter 20, and delivered to a tuner 23 via an IF (Intermediate Frequency) cable 22. Tuner 23 is connected to a television set 24 through which the viewer can watch a satellite broadcast.

Since satellite broadcast reception converter 20 equipped in satellite broadcast reception antenna device 30 includes a polarized wave separator 10 that can readily correct the property, the property can be corrected as necessary without having to modify the mold. Thus, a satellite broadcast reception antenna device of high performance can be realized at a low cost.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A polarized wave separator comprising:

a tubular waveguide, and a conductive partition extending in said waveguide along a longitudinal direction of said waveguide, wherein an end of said conductive partition in said longitudinal direction is a step-graded end taking a stepped configuration when viewed from a side, and a dielectric portion is disposed so as to cover at least a portion of said step-graded end when said step-graded end is viewed in said longitudinal direction.

2. The polarized wave separator according to claim 1, wherein said dielectric portion is formed of dielectric resin.

3. A converter for satellite broadcast reception, comprising the polarized wave separator defined in claim 1.

4. An antenna device for satellite broadcast reception, comprising the converter for satellite broadcast reception defined in claim 3.

5. A polarized wave separator comprising:

a tubular waveguide, a partition extending in said waveguide along a longitudinal direction of said waveguide, wherein an end of said partition in said longitudinal direction is a step-graded end taking a stepped configuration when viewed from a side, and a dielectric portion is disposed so as to cover at least a portion of said step-graded end when said step-graded end is viewed in said longitudinal direction, wherein said dielectric portion is formed of dielectric resin, and wherein said dielectric resin is resin selected from the group consisting of silicon type, epoxy type, acryl type, and urethane type.

6. A converter for satellite broadcast reception, comprising the polarized wave separator defined in claim 3.

7. An antenna device for satellite broadcast reception, comprising the converter for satellite broadcast reception defined in claim 6.

* * * * *